US005516324A

United States Patent [19]

Matsuyama et al.

[11] Patent Number: 5,516,324

[45] Date of Patent: May 14, 1996

[54] METHOD AND APPARATUS FOR GRINDING BALL GROOVES

[75] Inventors: Haruo Matsuyama; Toshikazu Murakami; Kazunori Kawai; Koji Hatanaka, all of Sayama, Japan

[73] Assignee: Honda Giken Kogyo Kabushiki Kaisha, Tokyo, Japan

[21] Appl. No.: 190,475

[22] Filed: Feb. 2, 1994

[30] Foreign Application Priority Data

| | | | |
|---|---|---|---|
| Feb. 3, 1993 | [JP] | Japan | 5-016290 |
| Dec. 17, 1993 | [JP] | Japan | 5-318414 |
| Dec. 28, 1993 | [JP] | Japan | 5-334783 |

[51] Int. Cl.[6] ..... B24B 1/00

[52] U.S. Cl. ..... 451/52; 451/127; 451/414

[58] Field of Search ..... 451/52, 21, 61, 451/51, 233, 130, 150, 155, 231, 27, 403, 121, 58, 143, 127, 414

[56] References Cited

U.S. PATENT DOCUMENTS

| | | | |
|---|---|---|---|
| 2,187,471 | 11/1937 | Hutchinson | 451/52 |
| 2,604,735 | 7/1952 | Kline | 451/52 |
| 3,005,297 | 10/1961 | Spicacci | 451/52 |
| 4,229,908 | 10/1980 | Panzeri . | |
| 4,536,991 | 8/1985 | Hoglund, Jr. | 451/414 |
| 4,890,420 | 1/1990 | Azimi | 451/414 |
| 5,197,228 | 3/1993 | Sharkey, III et al. | 451/27 |

FOREIGN PATENT DOCUMENTS

| | | |
|---|---|---|
| 60-26816 | 2/1985 | Japan . |
| 2005574 | 8/1978 | United Kingdom . |

*Primary Examiner*—Bruce M. Kisliuk
*Assistant Examiner*—Andrew Weinberg
*Attorney, Agent, or Firm*—Armstrong, Westerman, Hattori, McLeland & Naughton

[57] ABSTRACT

In a method of grinding ball grooves formed in a workpiece with a grind stone, the grind stone is fed in a direction of a longitudinal axis of the ball groove in a condition in which an axis of rotation of the grind stone is inclined in the direction of the longitudinal axis of the ball groove relative to a plane which perpendicularly crosses the longitudinal axis of the ball groove. An apparatus for grinding the ball groove has an apparatus bed which is movable in a direction of a longitudinal axis of the ball groove relative to a work holder for holding a workpiece, a supporting bed which is provided on the apparatus bed, a grind stone holder which rotatably mounts on a front end thereof a grind stone for grinding the ball groove, and an electric motor and a gear mechanism for rotating the grind stone. The grind stone holder, the electric motor and the gear mechanism are mounted on the supporting bed. The supporting bed is supported on the apparatus bed so as to be adjustable in inclination about an axis of inclination which is perpendicular to an axis of rotation of the grind stone and which passes through the center of the grind stone.

5 Claims, 4 Drawing Sheets

METHOD AND APPARATUS FOR GRINDING BALL GROOVES

BACKGROUND OF THE INVENTION

1. Field of the Invention

The present invention relates to a method and an apparatus for grinding ball grooves which are formed in each of two members for sliding one of them relative to the other via balls.

2. Description of Related Art

Conventionally, it is normal practice to grind ball grooves by feeding a grind stone along a longitudinal axis of the ball groove where an axis of rotation of the grind stone is positioned to perpendicular across the longitudinal axis of the ball groove (see, for example, Japanese Published Unexamined Patent Application No. 26816/1985).

Referring to FIG. 7, an angle $\alpha$ of contact is taken as an angle to be formed by an axial line of rotation of a ball B and that line of diameter of the ball B which passes through a point of contact of the ball B with a ball groove Wa. Then, the ball groove Wa formed in a workpiece W must be ground to a shape in which the angle $\alpha$ of contact falls within a predetermined range.

In the above-described conventional method of grinding, it is so arranged that the grinding of the ball groove is performed by using a grind stone which has been formed into a cross-sectional shape which coincides with the shape of a normal ball groove in which the angle of contact becomes a predetermined value. In this case, in order to confirm the accuracy of the shape of the grind stone, the following arrangement is adopted. Namely, a test machining or grinding is performed on a test piece made of a relatively soft material such as carbon or the like. When the shape of the groove obtained by this test machining is outside a predetermined allowable range, the grind stone is reformed to a predetermined shape.

Furthermore, a clearance groove is formed at the bottom of the ball groove. Therefore, when the ball groove is ground, out of the external peripheral surface of the grind stone, only those portions of the grind stone which serve to grind the side surfaces of the ball groove get worn. As a result, the shape of the groove becomes gradually narrower, with a consequent smaller angle of contact. In order to cope with this situation, in the conventional method, the grind stone is changed after every predetermined number of times of grinding the ball groove.

In the above-described conventional method, when the shape of the groove to be obtained by the test machining becomes narrower with a consequent smaller angle of contact, a large degree of correction is required in reforming the grind stone. At the same time, the previously performed reforming work will become utterly useless, resulting in a higher grinding cost. Further, since the grind stone must be changed frequently, the cost of grinding also becomes expensive.

In view of the above-described disadvantages, the present invention has an object of providing a method and an apparatus for grinding ball grooves in which, even if the accuracy in shape of the grind stone may be somewhat poorer, the grind stone can be used without reforming and in which the frequency of change in the grind stone can be decreased, with the result that the cost of grinding can be largely reduced.

According to one aspect of the present invention, the foregoing and other objects are attained by a method of grinding ball grooves formed in a workpiece with a grind stone, the method comprising the step of feeding the grind stone along a longitudinal axis of the ball groove wherein an axis of rotation of the grind stone is inclined at an angle relative to a plane which is perpendicular to the longitudinal axis.

According to another aspect of the present invention the foregoing and other objects are attained by an apparatus for grinding ball grooves formed in a workpiece comprising: an apparatus bed which is movable along a longitudinal axis of the ball groove relative to a work holder for holding a workpiece; a supporting bed which is provided on the apparatus bed; a grind stone holder which rotatably mounts on a front end thereof a grind stone for grinding the ball groove; driving means for rotating the grind stone, the grind stone holder and the driving means being mounted on the supporting bed; and means for adjustably supporting the supporting bed on the apparatus bed such that the supporting bed is adjustable in inclination about an axis line of inclination which is perpendicular to an axis line of rotation of the grind stone and which passes through the center of the grind stone.

If the supporting bed of the present invention apparatus is inclined on the apparatus bed, the direction of the axis line of rotation of the grind stone which is attached to the supporting bed via the grind stone holder varies. As a result, the axis line of rotation of the grind stone is inclined relative to the plane which perpendicularly crosses the axis line of the ball groove of the workpiece which is held on the work holder. If the apparatus bed is moved relative to the work holder, the grind stone will be fed as it is in the direction of the axial line of the ball groove to thereby grind the ball groove. Here, the shape of the ball groove will be broadened depending on the angle of inclination of the axis line of rotation, with the consequent increase in the angle of contact. Therefore, even if the shape of the groove at the time of test machining by feeding the grind stone in a direction perpendicular to the axis of rotation of the grind stone (the shape should then correspond to the cross section of the grind stone) has become narrower than the normal shape of the ball groove, a predetermined angle of contact can be obtained if the angle of inclination of the axis of rotation of the grind stone is set, by the adjustment of inclination of the supporting bed, to a value depending on the deviation of the shape of the groove from the normal shape. It follows that the grind stone can be used as it is without reforming, resulting in a reduction in cost. Further, if the inclination angle of the axis of the grind stone is increased by a predetermined angle after every predetermined number of times of grinding the ball groove, the decrease in the angle of contact due to wear of the grind stone can be compensated. Therefore, the angle of contact can be made to fall within a predetermined allowable range without changing the grind stone, with the result that the frequency of change in the grind stone can be decreased.

When the grind stone has worn, the surface of the grind stone is likely to become rougher due to dropping or disappearing of grinder particles, with the result that grinding lines or streaks are likely to be left on the ball groove. However, since the grind stone comes to rotate along or in parallel to the plane which crosses askew or at an angle to the axis line of the ball groove due to the inclination of the axis of rotation of the grind stone, the streaks will be smoothed by the feeding of the grind stone in the direction of the axis of the ball groove. The surface roughness of the ball groove will therefore not be impaired.

If the position of the grind stone is moved or shifted by the inclination of the supporting bed, the relative positional relationship of the work holder and the apparatus bed must be corrected. According to the present invention apparatus, however, the axis of inclination of the supporting bed is arranged to pass through the center of the grind stone and, therefore, the position of the grind stone will not be moved even if the supporting bed is inclined. The above-described correction is thus not required and the workability is improved.

In order to grind the ball grooves which are formed on an internal circumference of the workpiece, the grind stone holder must be formed in an elongated shape which can be inserted into the inside of the workpiece.

In this case, if there are provided a pair of arms which extend in the same direction as the grind stone holder at a distance therebetween in the direction of the axis of inclination such that the workpiece and the work holder can be disposed between the arms, and if the supporting bed is pivotally supported on the apparatus bed via the pair of arms, the following advantages can be obtained. Namely, even if the supporting bed is pivotally supported on the axis of inclination which passes through the center of the grind stone which is rotatably mounted on the front end of the grind stone holder, there will occur no interference of the supporting bed with the workpiece and the work holder. Further, the supporting rigidity of the supporting bed relative to the apparatus bed can also be secured.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

The illustrated embodying example shows the present invention as applied to an apparatus for grinding ball grooves Wa which are formed on an internal circumference of a workpiece W which comprises a movable pulley of a continuously variable speed V-belt transmission.

Figure 1:
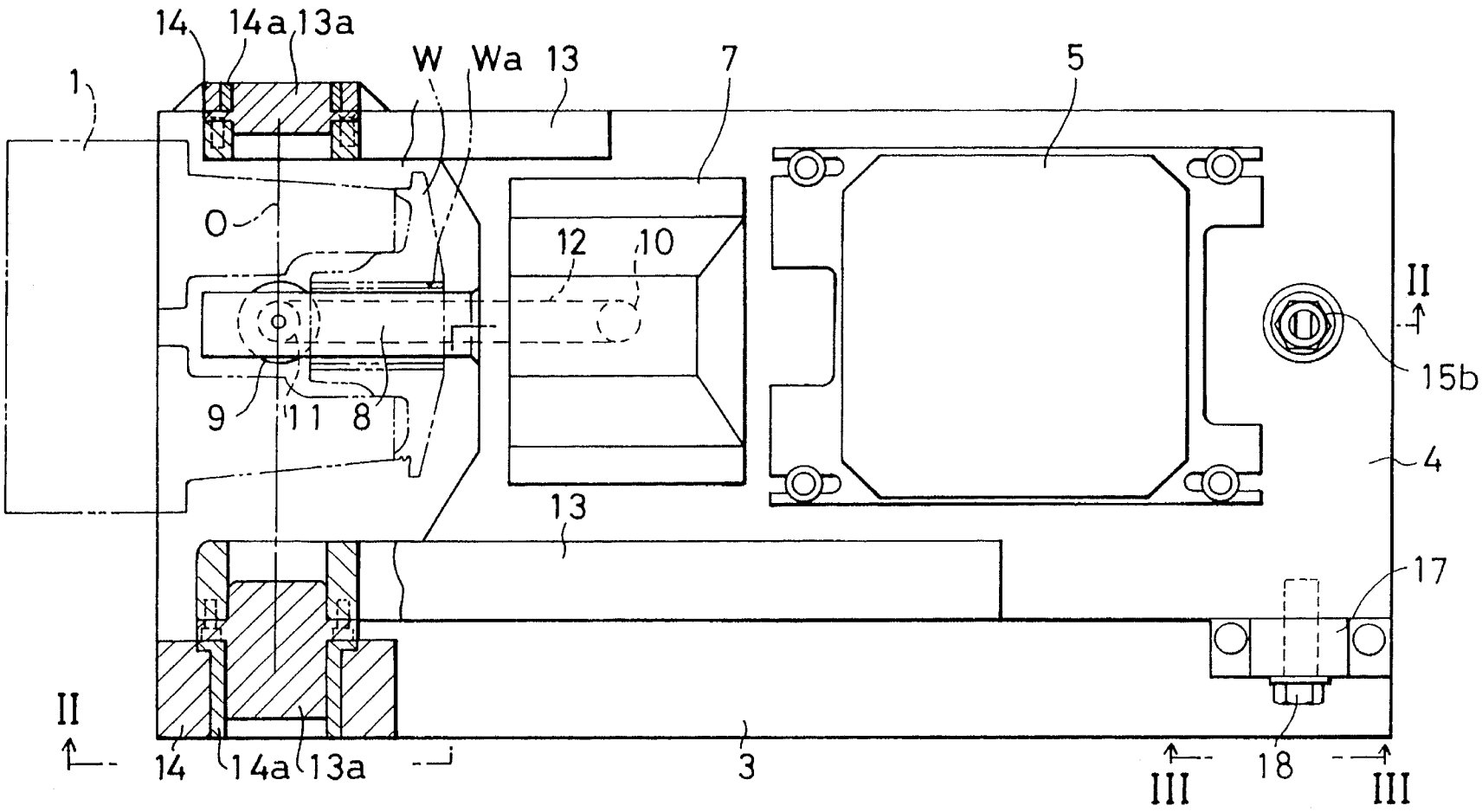
FIG. 1 is a plan view of a preferred exemplary embodiment of an apparatus according to the present invention.
Figure 2:
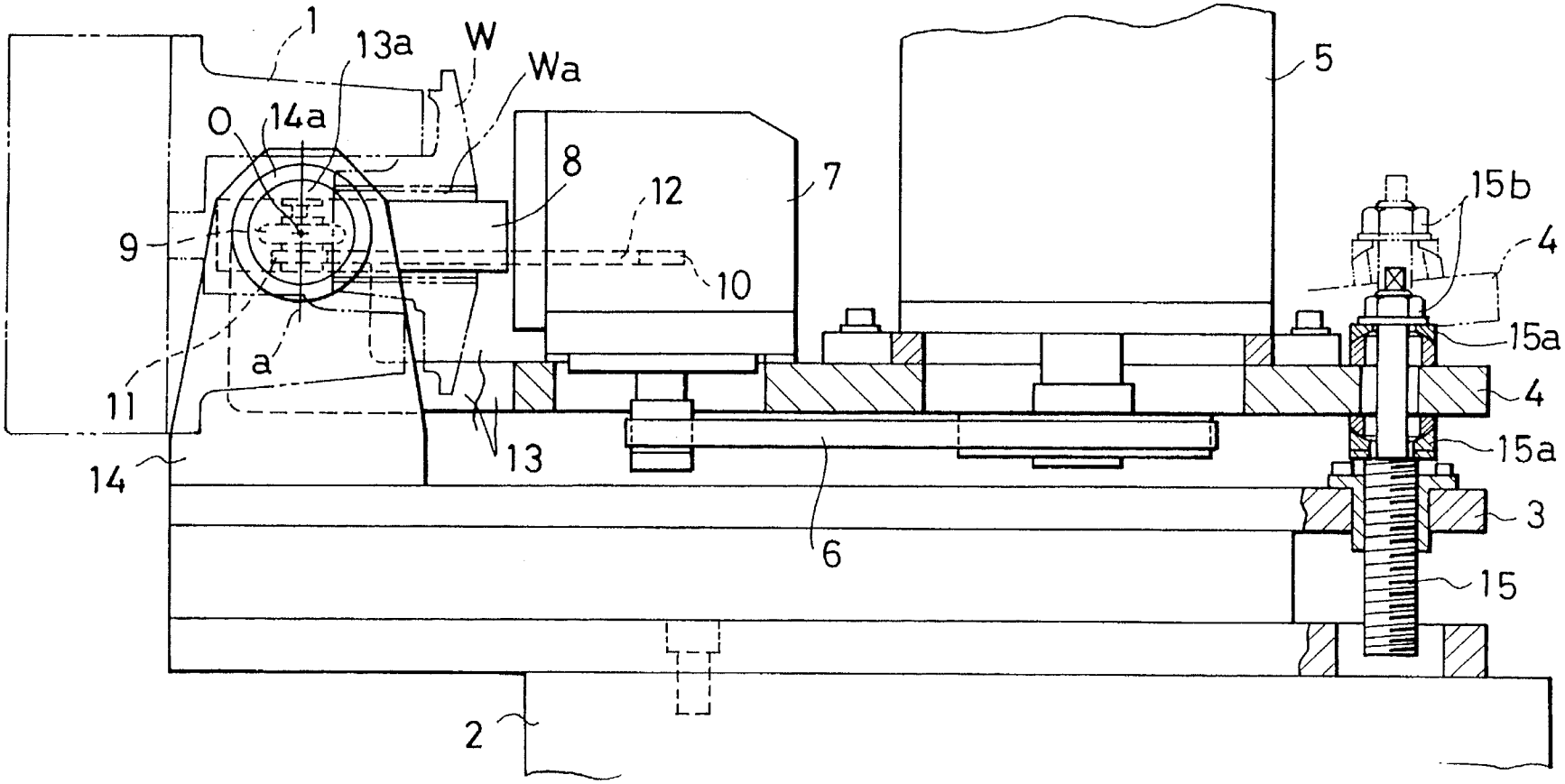
FIG. 2 is a sectional side view taken along the line II—II in FIG. 1.

Referring to FIGS. 1 and 2, numeral 1 denotes a work holder for holding the workpiece W. A grinding apparatus is provided opposite or in a position facing this work holder 1.

The grinding apparatus is provided with an apparatus bed 3 which is fixed on a slide table 2 slidable towards the work holder 1, and a supporting bed 4 which is pivotally mounted on the apparatus bed 3 so as to be inclinable as described in more detail hereinafter.

On the supporting bed 4 there are mounted an electric motor 5 and a gear box 7 which contains therein a gear mechanism to be driven by the electric motor 5 via a belt 6. At the front end of the gear box 7 there is provided in a projecting manner an elongated hollow grind stone holder 8 which can be inserted into the inside of the workpiece W. At the front end of the grind stone holder 8 a grind stone 9 is mounted in a horizontally or laterally rotatable manner. Within the grind stone holder 8 a belt 12 is wound around a driving pulley 10 which is inside the gear box 7 and a driven pulley 11 which is coaxial with the grind stone 9 so that the grind stone 9 can be rotated by the electric motor 5 via the belt 6, the gear mechanism and the belt 12.

On the supporting bed 4 there are provided in a projecting manner a pair of right and left arms 13, 13 which extend in the same direction as the grind stone holder 8, i.e., in the forward direction, with a space therebetween sufficient for receiving therein the workpiece W and the work holder 1. At the front end of each of the arms 13, 13, there is mounted a pivot shaft **13*a* which is positioned along a horizontal axis 0 of inclination which perpendicularly crosses the axis of rotation of the grind stone 9 and which passes through the center of the grind stone 9. On both right and left front end sides of the apparatus bed 3 there are provided in a projecting manner a pair of brackets 14, 14. A bearing sleeve 14*a* is fitted onto an upper end portion of each of the brackets 14, 14 and the pivot shaft 13*a* of each of the arms 13, 13 is rotatably fitted into each bearing sleeve 14*a*. According to this arrangement, the supporting bed 4 can be inclined about the axis 0** of inclination.

Figure 3:
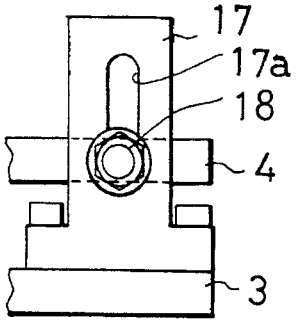
FIG. 3 is a side view viewed from the line III—III in FIG. 1.

In the rear portion of the apparatus bed 3 there is inserted in a threading manner an adjusting bolt 15 which extends upwards. This adjusting bolt 15 is loosely inserted into the rear portion of the supporting bed 4, and a pair of spherical washers **15*a*, 15*a*, which are positioned respectively on the upper and lower sides of the supporting bed 4, are mounted. By means of a nut 15*b* which is disposed on the upper end of the adjusting bolt 15 the supporting bed 4 is held in a pinching manner between both washers 15*a*, 15*a* to thereby connect the rear end of the supporting bed 4 to the adjusting bolt 15. In this arrangement, by rotating the adjusting bolt 15 to move it up and down, the supporting bed 4 can be adjusted in an inclining manner. Each of the spherical washers 15*a*, 15*a* is constituted by a pair of washer pieces which come into contact with each other on their spherical surfaces. Therefore, they function to allow for the inclination of the supporting bed 4 relative to the axial line of the adjusting bolt 15. Further, at the rear end of the apparatus bed 3 there is vertically provided a guide piece 17 so as to extend along a side edge of the supporting bed 4. As shown in FIG. 3, there is formed in the guide piece 17 a slot 17*a* which is made arcuate about the axis of inclination. In this manner, it is so arranged that the supporting bed 4 can be fixed at an arbitrarily inclined position by a fixing screw 18 which is inserted in a threading manner into the supporting bed 4 through the slot 17*a***.

The above-described work holder 1 is arranged to rotate the workpiece W by indexing at an angle equal to a circumferential pitch of plural ball grooves Wa which are formed on the internal circumference of the workpiece W. The grinding work is performed in sequence in the following manner. Namely, each of the ball grooves Wa is indexed to the phase coinciding with the grind stone 9. In this condition, the apparatus bed 3 is advanced forwards in the direction of the work holder 1 by the movement of the slide table 2 to thereby insert the grind stone holder 8 into the inside of the workpiece W. The grind stone 9 is then fed or moved in the direction of the longitudinal axis of the ball groove Wa, i.e., in the longitudinal direction of the workpiece W to perform the grinding work of the ball groove Wa.

Figure 4:
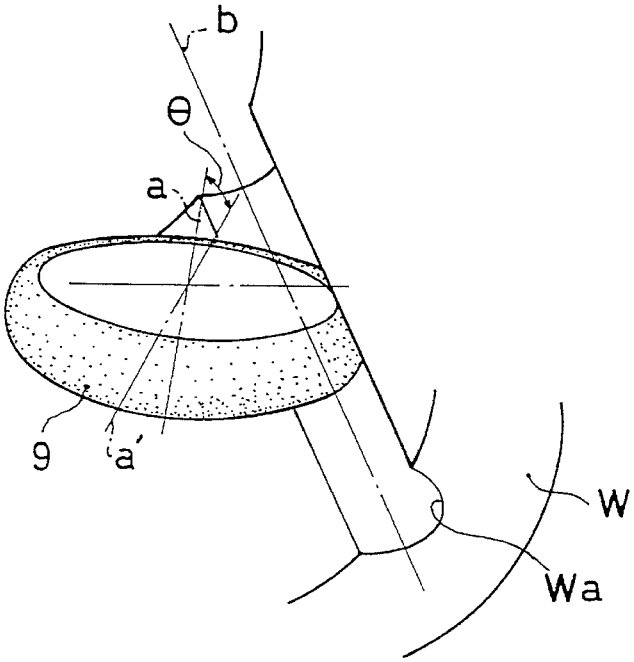
FIG. 4 is a perspective view showing the condition of grinding of a ball groove.
Figure 7:
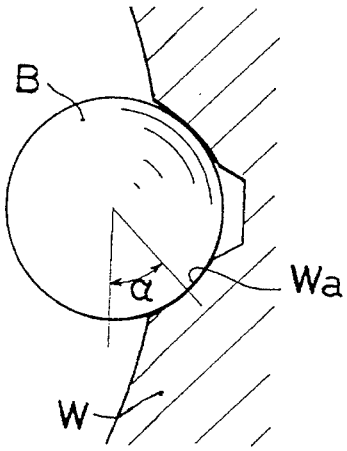
FIG. 7 is a diagram showing the contact of a ball with a ball groove.

In this case, if the supporting bed 4 is inclined by a predetermined angle, as shown in FIG. 4, the axis "a" of rotation of the grind stone 9 will cross, at a predetermined angle θ, a line a' which lies on a plane perpendicular to the axis of the ball groove Wa.

Figure 5:
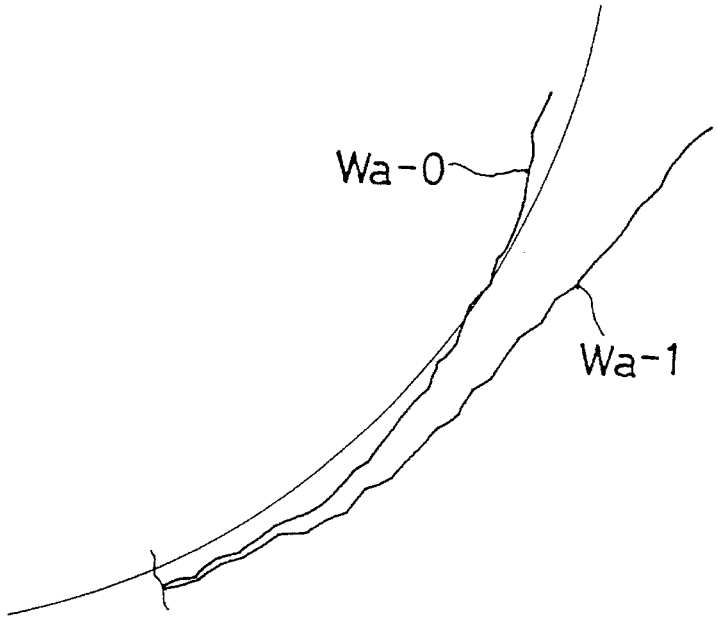
FIG. 5 a diagram showing the change in ground shape depending on the inclination of the grind stone.

Next, changes in the shape of the ball groove Wa due to this change in the angle θ of inclination will be explained with reference to FIG. 5. FIG. 5 shows a ground shape, as enlarged in the direction of curvature, of one side surface of the ball groove Wa. In the Figure, the line represented by Wa-0 shows a cross-sectional shape of the ball groove Wa worked or ground at an angle θ=0. The line represented by Wa-1 shows a cross-sectional shape of the ball groove Wa ground at an angle θ=2°. As can be seen therefrom, when the shape of the line Wa-0, in which the shape of the grind stone 9 has been directly transferred or represented as it is, is smaller than an allowable range, resulting in a smaller angle of contact, the angle of contact can be increased as a result of broadening the shape of the ball groove Wa, by inclining the axis "a" of rotation.

Figure 6:
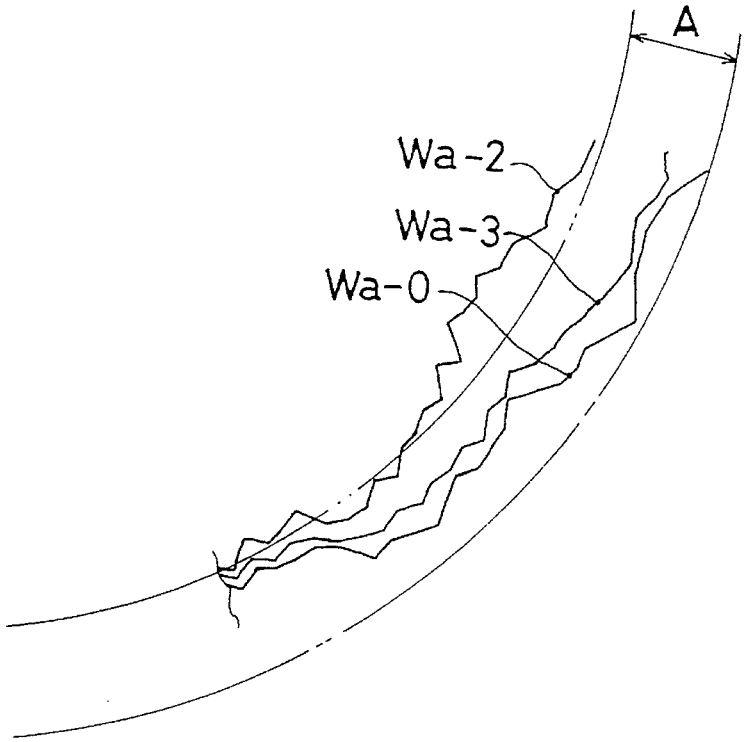
FIG. 6 is a diagram showing the change in ground shape depending on the wear of the grind stone and the inclination of the grind stone shaft.

Furthermore, as shown in FIG. 6, even if the shape of the ball groove as represented by Wa-0 at the time of beginning the grinding work may fall within the allowable range A, the shape of the ball groove Wa becomes narrower as a result of grinding work for a predetermined number of times as represented by Wa-2. Consequently, the shape of the ball groove falls outside the allowable range A and the angle of contact becomes smaller than required. In such a case, if the angle θ is increased by 1°, the shape of the ball groove Wa varies from the condition as represented by the line Wa-2 to the condition as represented by the line Wa-3. As a result, the shape of the groove returns to the allowable range A and the grinding work of the ball groove Wa can be continued. In addition, by the adjustment of the angle θ of inclination, ball grooves Wa of various angles α of contact can be ground using the same grind stone 9.

By the way, when the grind stone 9 has worn, the surface of the grind stone 9 becomes rough due to dropping or disappearing of grinding particles, with the result that grinding lines or streaks are left on the ball groove Wa along the surface of revolution of the grind stone 9. In case the axis "a" of rotation of the grind stone 9 is made to follow, or lie along or parallel to the plane that perpendicularly crosses the longitudinal axis b of the ball groove, the surface of revolution of the grind stone 9 will become parallel to the longitudinal axis of the ball groove which is the same as the direction of feeding the grind stone 9. The streaks which extend in the direction of the longitudinal axis of the ball groove will, therefore, remain as they are. On the other hand, if the axis "a" of rotation of the grind stone 9 is inclined as described in the above embodiment, the surface of revolution of the grind stone 9 crosses the longitudinal axis b of the ball groove askew or at an angle. Therefore, the streaks which are made along the surface of revolution will be smoothed by the feeding of the grind stone 9 in the direction of the longitudinal axis of the ball groove, and the surface roughness of the ball groove Wa becomes smaller and the groove surface becomes smoother.

Furthermore, in this embodiment, since the axis 0 of inclination of the supporting bed 4 passes through the center of the grind stone 9, the position of the grind stone 9 will not be moved or shifted. Therefore, the correction of the relative positional relationship between the work holder 1 and the apparatus bed 3 in the direction of inclination of the supporting bed 4 becomes needless, resulting in an improved workability.

In the above embodiment, the apparatus bed 3 is made to be movable in the direction of the longitudinal axis of the ball groove Wa by the movement of the slide table 2. It may, however, be arranged that the work holder 1 is movable in the axial direction of the ball groove. What is necessary here is that the work holder 1 and the apparatus bed 3 are made to be movable relative to each other in the direction of the longitudinal axis of the ball groove.

In the above embodiment, grinding is made of ball grooves Wa on the internal circumference of the workpiece W. The present invention can, of course, be applied to the grinding of ball grooves formed on the external periphery of a shaft on the outside of which a movable pulley is inserted, or ball grooves of other workpieces.

It is readily apparent that the above described method and apparatus for grinding ball grooves meet all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of grinding ball grooves formed in a workpiece with a grind stone, said method comprising the step of feeding the grind stone along a longitudinal axis of the ball groove wherein an axis of rotation of the grind stone is inclined at an angle relative to a plane which is perpendicular to the longitudinal axis of the ball groove.

2. A method of grinding ball grooves according to claim 1, further comprising the steps of:

performing a test machining by feeding the grind stone in a direction perpendicular to the axis of rotation of the grind stone;

comparing a shape of groove obtained by the test machining and a normal shape of groove to thereby measure a deviation of the obtained shape of groove from the normal shape; and adjusting an angle of inclination of the axis of rotation of the grind stone relative to the plane which is perpendicular to the longitudinal axis of the ball groove depending on the deviation.

3. A method of grinding ball grooves according to claim 2, wherein the angle of inclination is increased by a predetermined angle after every predetermined number of times of grinding the ball groove.

4. An apparatus for grinding ball grooves formed in a workpiece comprising:

an apparatus bed which is movable in a direction of a longitudinal axis of the ball groove relative to a work holder for holding a workpiece;

a supporting bed which is provided on said apparatus bed;

a grind stone holder which rotatably mounts on a front end thereof a grind stone for grinding the ball groove;

driving means for rotating the grind stone, said grind stone holder and said driving means being mounted on said supporting bed; and means for adjustably supporting said supporting bed on said apparatus bed such that said supporting bed is adjustable in inclination about an axis of inclination which is perpendicular to an axis of rotation of the grind stone and which passes through the center of the grind stone.

5. An apparatus for grinding ball grooves according to claim 4, wherein said ball grooves are formed on an internal circumference of the workpiece, and wherein said grind stone holder is formed in an elongated shape so as to be insertable into an inside of the workpiece, said apparatus further comprising:

a pair of arms which extend in the same direction as the grind stone holder and which are provided in the direction of the axis of inclination such that the workpiece and said work holder can be disposed therebetween;

wherein said supporting bed is pivotally supported on said apparatus bed so as to be inclinable via said pair of arms.

* * * * *